US006997549B2

(12) United States Patent
Howarth et al.

(10) Patent No.: US 6,997,549 B2
(45) Date of Patent: Feb. 14, 2006

(54) MEDIA HOLD DOWN SYSTEM

(75) Inventors: Steven J. Howarth, Vancouver, WA (US); Ray L. Pickup, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 13 days.

(21) Appl. No.: 10/788,186

(22) Filed: Feb. 26, 2004

(65) Prior Publication Data

US 2005/0190250 A1 Sep. 1, 2005

(51) Int. Cl.
*B65H 5/00* (2006.01)

(52) U.S. Cl. ..... 347/104; 271/193; 271/276; 271/101; 271/407.1

(58) Field of Classification Search ..... 347/102, 347/104; 271/193, 276; 101/407.1
See application file for complete search history.

(56) References Cited

U.S. PATENT DOCUMENTS

| | | | | |
|---|---|---|---|---|
| 2,576,882 | A * | 11/1951 | Koole et al. | 198/691 |
| 3,690,646 | A | 9/1972 | Kolibas | |
| 3,916,270 | A | 10/1975 | Wachtler | |
| 4,207,579 | A | 6/1980 | Gamblin et al. | |
| 4,453,841 | A | 6/1984 | Bobick | |
| 4,751,609 | A | 6/1988 | Kasahara | |
| 4,803,500 | A | 2/1989 | Milbrandt | |
| 4,821,049 | A | 4/1989 | Eckl | |
| 4,872,027 | A | 10/1989 | Buskirk et al. | |
| 4,982,207 | A | 1/1991 | Tunmore | |
| 5,041,718 | A | 8/1991 | O'Hondt et al. | |
| 5,094,613 | A | 3/1992 | Dolcimascolo et al. | |
| 5,173,834 | A | 12/1992 | Sogoh | |
| 5,216,442 | A * | 6/1993 | Parks et al. | 346/134 |
| 5,241,159 | A | 8/1993 | Chatteriee et al. | |
| 5,342,133 | A | 8/1994 | Canfield | |
| 5,345,863 | A | 9/1994 | Kurata et al. | |
| 5,369,424 | A | 11/1994 | Hori | |
| 5,419,644 | A | 5/1995 | Martin et al. | |
| 5,428,383 | A | 6/1995 | Shields et al. | |
| 5,461,482 | A | 10/1995 | Wilson et al. | |
| 5,570,118 | A | 10/1996 | Rezanka et al. | |
| 5,593,151 | A | 1/1997 | Mashtare et al. | |
| 5,593,240 | A | 1/1997 | Broder et al. | |
| 5,668,584 | A | 9/1997 | Broder et al. | |
| 5,712,672 | A | 1/1998 | Gooray et al. | |
| 5,714,736 | A | 2/1998 | Yoneda et al. | |
| 5,737,178 | A | 4/1998 | Herchen | |
| 5,771,054 | A * | 6/1998 | Dudek et al. | 347/102 |
| 5,784,090 | A | 7/1998 | Selensky et al. | |
| 5,821,968 | A | 10/1998 | Ohyama et al. | |
| 5,886,866 | A * | 3/1999 | Hausmann | 361/234 |
| 5,896,154 | A * | 4/1999 | Mitani et al. | 347/102 |
| 6,120,143 | A * | 9/2000 | Narushima et al. | 347/104 |
| 6,152,444 | A | 11/2000 | Elgee et al. | |
| 6,168,269 | B1 | 1/2001 | Rasmussen et al. | |

(Continued)

FOREIGN PATENT DOCUMENTS

| | | |
|---|---|---|
| EP | 0583016 | 9/1997 |

(Continued)

OTHER PUBLICATIONS

Alec J. Babiarz, "Developing a Low-Cost Electrostatic Chart-Hold Table" 2 pages.

*Primary Examiner*—Andrew H. Hirshfeld
*Assistant Examiner*—Jill E. Culler

(57) ABSTRACT

A media hold down system includes electrodes configured to create an electric field at a surface and a vacuum source configured to create a vacuum at the surface.

46 Claims, 10 Drawing Sheets

U.S. PATENT DOCUMENTS

| | | | | |
|---|---|---|---|---|
| 6,215,643 | B1 | 4/2001 | Nagasaki | |
| 6,224,203 | B1 | 5/2001 | Wotton et al. | |
| 6,309,063 | B1 * | 10/2001 | Kamano et al. | 347/104 |
| 6,309,064 | B1 * | 10/2001 | Tanno et al. | 347/104 |
| 6,336,722 | B1 | 1/2002 | Wotton et al. | |
| 6,436,843 | B1 | 8/2002 | Meinhold | |
| 6,454,478 | B1 | 9/2002 | Wotton et al. | |
| 6,467,410 | B1 | 10/2002 | Rasmussen et al. | |
| 6,508,540 | B1 | 1/2003 | Lean et al. | |
| 6,511,172 | B1 | 1/2003 | Tanno et al. | |
| 6,529,220 | B1 * | 3/2003 | Matsumoto | 346/140.1 |
| 6,588,580 | B1 | 7/2003 | Janzen | |
| 6,595,515 | B1 | 7/2003 | Numata et al. | |
| 2003/0016269 | A1 * | 1/2003 | Sekiya | 347/42 |

FOREIGN PATENT DOCUMENTS

| | | | |
|---|---|---|---|
| EP | 1207045 | | 5/2002 |
| JP | 03130158 | A * | 6/1991 |
| JP | 10087102 | | 4/1998 |
| JP | 2000143026 | | 5/2000 |
| JP | 2000191175 | | 7/2000 |
| JP | 2002302287 | | 10/2002 |

* cited by examiner

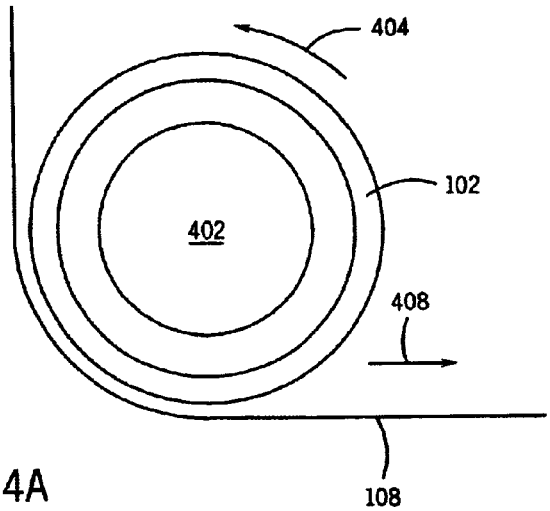
FIG. 4A
FIG. 4B
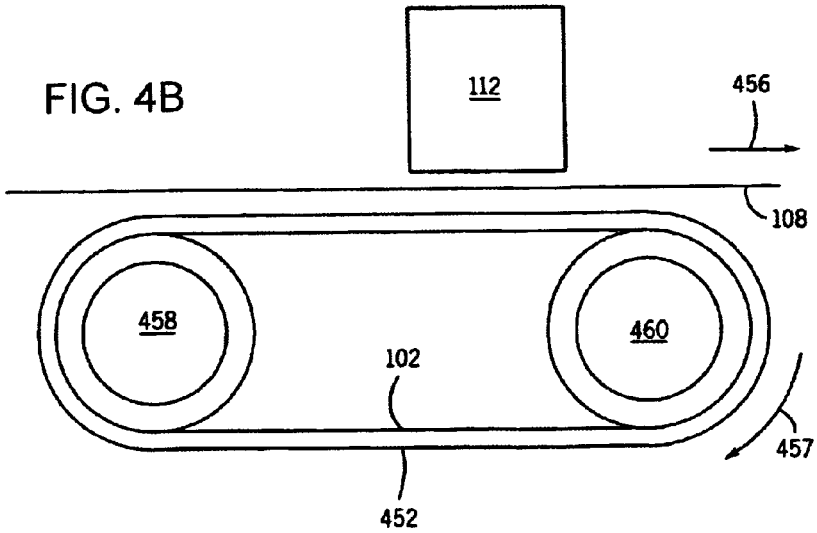

MEDIA HOLD DOWN SYSTEM

CROSS-REFERENCE TO RELATED PATENT APPLICATION

The present application is related to co-pending U.S. patent application Ser. No. 10/445,162 filed on May 24, 2003 by David E. Smith, Robert M. Yraceburu and Stephen McNally and entitled "Media Electrostatic Hold Down and Conductive Heating Assembly," the full disclosure of which is hereby incorporated by reference.

BACKGROUND

Inkjet printers have become popular for printing on media, especially when precise printing of color images is needed. For instance, such printers have become popular for printing color image files generated using digital cameras, for printing color copies of business presentations, and so on. An inkjet printer is more generically a fluid-ejection device that ejects fluid, such as ink, onto media, such as paper.

During printing, a large amount of ink may be ejected onto the media in a short amount of time. As the media absorbs moisture, the media expands. This expansion of the media is commonly known as cockle. Cockle of the media results in undesirable wrinkling of the printed media.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

FIGS. 4A and 4B are diagrams depicting how a dielectric of a media hold down and heating assembly can be implemented as or within a drum and a belt, respectively, according to varying example embodiments.

DETAILED DESCRIPTION OF EXAMPLE EMBODIMENTS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention.

Media Electrostatic Hold Down and Conductive Heating Assembly 100

Figure 1:
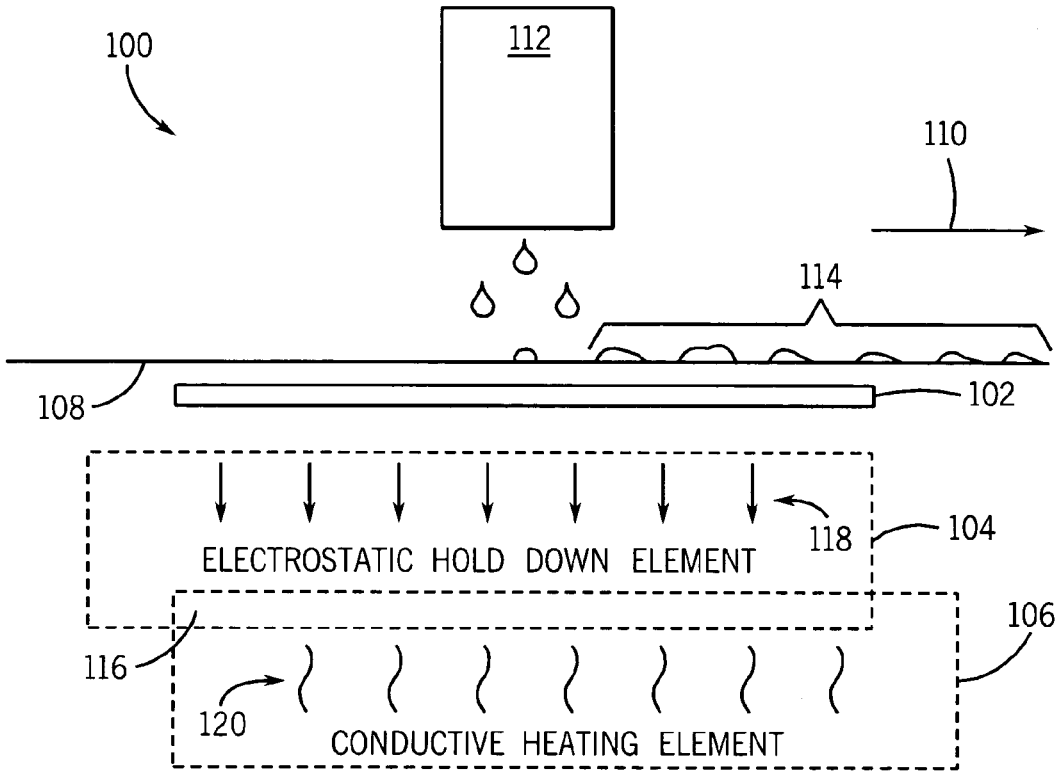
FIG. 1 is a diagram of a side view of a media hold down and heating assembly, according to an example embodiment.

FIG. 1 shows a side view of a media hold down and heating assembly 100, according to an embodiment of the invention. The assembly 100 is specifically depicted in FIG. 1 in which a fluid-ejection mechanism 112, such as an inkjet printhead, ejects fluid 114, such as ink, onto media 108 which is moved in the direction indicated by arrow 110. The media 108 in this case may be paper, transparencies, cardboard, or another type of media that is amenable to receiving fluid ejection. However, in other embodiments of the invention, the assembly 100 can be utilized in conjunction with other types of media in which the fluid-ejection mechanism 112 is not present. For instance, the assembly 100 may be utilized in conjunction with media that is a semiconductor wafer, for utilization in semiconductor processing.

The media hold down and heating assembly 100 includes a dielectric 102, an electrostatic hold down element 104 and a conductive heating element 106. The dielectric 102 may be a polymer or plastic strip or sheet, or another type of dielectric. The dielectric 102, in some embodiments, may be solid, without any perforations or holes. The electrostatic hold down element 104 and the conductive heating element 106 may share some components, as indicated by the overlapping region 116 between the elements 104 and 106. Furthermore, some of the components of the element 104 and/or 106 may be at least partially embedded or situated within the dielectric 102, which is not specifically depicted in FIG. 1.

The electrostatic hold down element 104 generates an electric field that attracts, or holds down, the media 108 against the dielectric 102, as indicated by the arrows 118. By holding the media 108 against dielectric 102, element 104 reduces or prevents expansion of the media 108 as the media 108 gradually absorbs moisture to minimize or prevent cockle. In the embodiment shown, element 104 is a capacitive hold down element. The element 104 performs this electrostatic hold down functionality so that the media 108 is properly positioned against the dielectric 102 for the fluid-ejection mechanism 112 to eject the fluid 114 on the media 108. The conductive heating element 106 generates heat, as indicated by the squiggly lines 120, that conducts through the dielectric 102 and to the media 108 and the fluid 114 that has been ejected onto the media 108. The element 106 performs this conductive heating functionality to dry or expedite drying of the fluid 114 that has been ejected onto the media 108. By expediting drying of the fluid 114, heating element 106 further minimizes cockle resulting from absorption of the fluid 114 by media 108.

Figure 2:
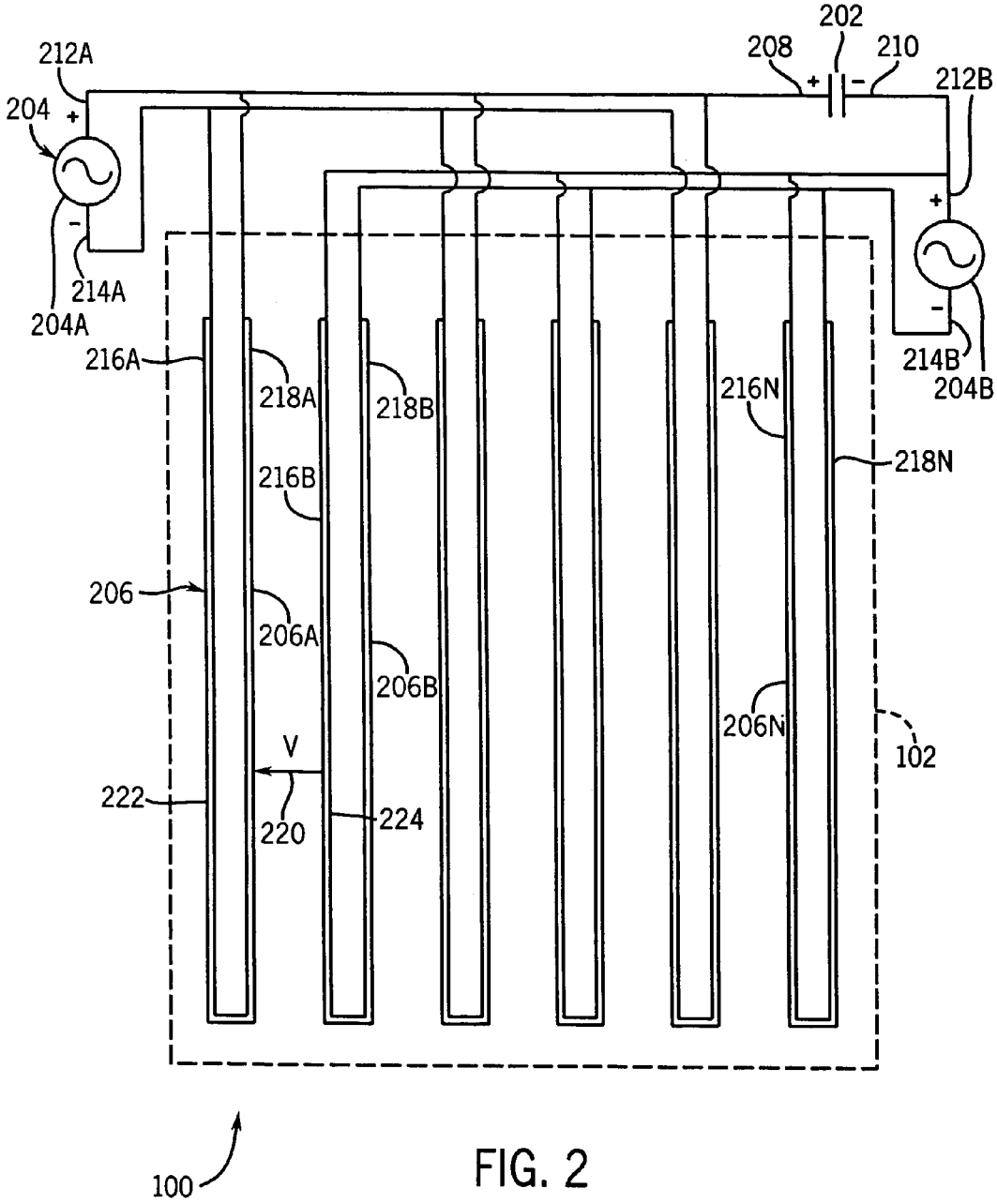
FIG. 2 is a diagram of a cross-sectional top view of a media hold down and heating assembly, according to an example embodiment.

FIG. 2 shows a top view of the media hold down and heating assembly 100 in detail, according to an embodiment of the invention. The electrostatic hold down element 104 of FIG. 1 is inclusive of a high-voltage source 202 and a number of electrodes 206A, 206B, . . . , 206N, which are collectively referred to as the electrodes 206. The electrodes 206 may also be referred to as resistive elements without loss of generality. The conductive heating element 106 of FIG. 1 is inclusive of a pair of current sources 204A and 204B (also known as electric heater power supplies) as well as the electrodes 206. The elements 104 and 106 thus share the electrodes 206 between themselves. The dielectric 102 is indicated as a dotted line, to indicate the cross-sectional nature of FIG. 2, such that the electrodes 206 are situated under at least the top surface of the dielectric 102, on which the media 108 is positioned in FIG. 1.

The high-voltage source 202 has a positive terminal 208 and a negative terminal 210. The electric heater power supply 204A has a positive terminal 212A and a negative terminal 214A, whereas the electric heater power supply 204B has a positive terminal 212B and a negative terminal 214B. Each of the electrodes 206 may be substantially shaped as an elongated U having two ends. For instance, the electrode 206A has a first end 216A and a second end 218A, the electrode 206B has a first end 216B and a second end 218B, and the electrode 206N has a first end 216N and a second end 218N. Although there are six of the electrodes 206 in FIG. 2, this is provided as an illustrative example, and other embodiments may have more or fewer of the electrodes 206. The electrodes 206 are situated or positioned parallel to one another on their long sides.

The electrodes 206 may be logically numerated from the first electrode 206A to the last electrode 206N, such that the electrodes 206 include both odd-numbered and even-numbered electrodes. The positive terminal 212A of the first electric heater power supply 204A is connected to the positive terminal 208 of the high-voltage source 202 and to the second ends 218 of odd-numbered of the electrodes 206, whereas the negative terminal 214A of the first electric heater power supply 204A is connected to the first ends 216 of the odd-numbered of the electrodes 206. The positive terminal 212B of the second electric heater power supply 204B is connected to the negative terminal 210 of the high-voltage source 202 and to the first ends 216 of even-numbered of the electrodes 206, whereas the negative terminal 214B of the second electric heater power supply 204B is connected to the second ends 218 of the even-numbered of the electrodes 206. Additional details regarding this spatial positioning of the electrodes 206, the electric heater power supplies 204, and the high-voltage source 202 of this embodiment of the invention are described below.

The high-voltage source 202 creates an electric field between adjacent electrodes 206. This is the electric field that electrostatically attracts the media 108 against the dielectric 102 in FIG. 1. The electric heater power supplies 204 cause the electrodes 206 to generate heat. This is the heat that conducts through the dielectric 102 to the media 108 and the fluid 114 ejected thereon in FIG. 1. Also depicted in FIG. 2 is a voltage 220 between a point 222 of the electrode 206A and a point 224 of the electrode 206B, as is specifically described below.

Figure 3A:
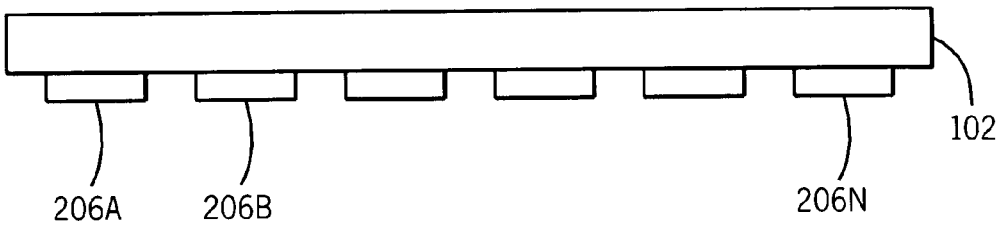
FIGS. 3A and 3B are diagrams of side views depicting how electrodes of a media hold down and heating assembly can be situated within a dielectric of the assembly,. according to varying embodiments.
Figure 3B:
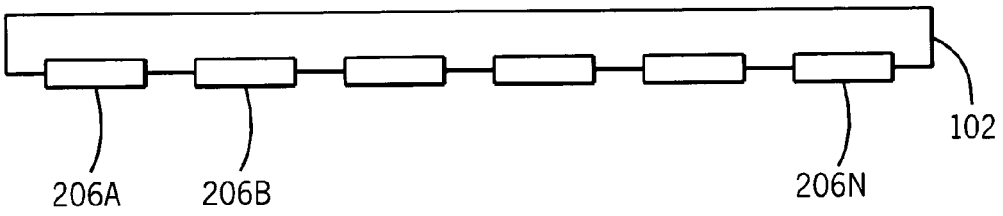

FIGS. 3A and 3B show side views of different manners by which the electrodes 206 may be situated or positioned relative to the dielectric 102, according to varying embodiments of the invention. In FIG. 3A, the electrodes 206 are situated or positioned under the dielectric 102. The electrodes 206 may or may not make actual contact with the dielectric 102. In FIG. 3B, the electrodes 206 are partially situated, positioned, or disposed within the dielectric 102. The electrodes 206 may also be completely disposed within the dielectric 102.

FIGS. 4A and 4B show how the dielectric 102 may be implemented, according to varying embodiments of the invention. In the side view of FIG. 4A, the dielectric 102 is part of or includes a drum 402 that rotates counterclockwise, as indicated by the arrow 404. The media 108 moves around the drum 402 as is depicted in FIG. 4A, ultimately moving in the direction indicated by the arrow 408. In the side view of FIG. 4B, the dielectric 102 is part of or includes a belt 452 that moves clockwise, as indicated by the arrow 457, around the pulleys 458 and 460. The belt 460 moves the media 108 from left to right, as indicated by the arrow 456, under the fluid-ejection mechanism 112, which may be stationary, or move in and out of the plane of FIG. 4B. By comparison to FIGS. 4A and 4B, the previously described FIG. 1 can be considered in one embodiment to depict the dielectric 102 as part of or included in a platen.

Non-Interference Between Hold Down Element and Heating Element

In at least some embodiments of the invention, the electrostatic hold down element 104 and the conductive heating element 106 of the media hold down and heating assembly 100 of FIG. 1 do not affect one another. For instance, the electric field generated by the electrostatic hold down element 104 is not affected by the conductive heating element 106, such that the elements 104 and 106 do not interfere with one another in the functionalities that they perform. More specifically, the electrodes 206, the electric heater power supplies 204, and the high-voltage source 202 of FIG. 2 are spatially positioned such that the electric field created by the high-voltage source 202 within the electrodes 206 is unaffected by the electric heater power supplies 204.

Such non-interference between the high-voltage source 202 and the electric heater power supplies 204 of FIG. 2 is demonstrated in one specific embodiment by the voltage between each adjacent pair of electrodes 206, such as the voltage 220 of FIG. 2 between the points 222 and 224, being equal to the voltage of the high-voltage source 202. Because the voltage between each adjacent pair of electrodes 206 is equal to the voltage of the high-voltage source 202, the electric heater power supplies 204 do not affect the high-voltage source 202 and thus do not affect the electric field created by the high-voltage source 202 within the electrodes 206. This is now particularly described in relation to the voltage 220 being equal to the voltage of the high-voltage source 202.

The hold down force is caused by an electric field between adjacent electrodes 206, such as the electrodes 206A and 206B. The electric field is generated by the voltage difference between the electrodes 206A and 206B, also referred to as the voltage 220. Where the resistance of the electrodes 206 is equal, the resistance from the second end 218A to the point 222 of the electrode 206A, referred to as $R_{be}$, is identical to the resistance from the first end 216B to the point 224 of the electrode 206B, referred to as $R_{cf}$. Likewise, the resistance from the first end 216A to the point 222 of the electrode 206A, referred to as $R_{ae}$, is identical to the resistance from the second end 218B to the point 224 of the electrode 206B, referred to as $R_{df}$.

The voltage between the points 222 and 224 is then given by:

$$V_{ef}=V_{eb}+HV+V_{cf} \quad (1)$$

where $V_{ef}$ is the voltage 220, $V_{eb}$ is the voltage from the point 222 to the second end 218 of the first electrode 206A, HV is the voltage of the high-voltage source 202, and the voltage $V_{cf}$ is the voltage from the point 224 to the first end 216B of the second electrode 206B. Since $$V_{ef} = -\frac{V_{ht1}R_{be}}{R_{be} + R_{ae}}, \tag{2}$$

where $V_{ht1}$ is the voltage of the first electric heater power supply 204A, and since $$V_{cf} = \frac{V_{ht2}R_{cf}}{R_{cf} + R_{df}}, \tag{3}$$

where $V_{ht2}$ is the voltage of the second electric heater power supply 204B, then $$V_{ef} = \frac{V_{ht1}R_{be}}{R_{be} + R_{ae}} + HV + \frac{V_{ht2}R_{cf}}{R_{cf} + R_{df}}. \tag{4}$$

Further, since $R_{cf}$ equals $R_{be}$ and $R_{df}$ equals $R_{ae}$, then $$V_{ef} = \frac{V_{ht1}R_{be}}{R_{be} + R_{ae}} + HV + \frac{V_{ht2}R_{be}}{R_{be} + R_{ae}}, \tag{5}$$

or, $$V_{ef} = \frac{(V_{ht2} - V_{ht1})R_{be}}{R_{be} + R_{ae}} + HV. \tag{6}$$

Thus, if $V_{ht1}$ equals $V_{ht2}$, then $$V_{ef}=HV \tag{7}$$

Therefore, if the voltage of the first electric heater power supply 204A is equal to the voltage of the second electric heater power supply 204B, then the voltage 220, which is representative of the voltage between each adjacent pair of the electrodes 206, is equal to the voltage of the high-voltage source 202. This means that, in some embodiments, the electric heater power supplies 204 do not affect or interfere with the electric field created by the high-voltage source 202 within the electrodes 206. The voltages of the electric heater power supplies 204 are equal to one another in one embodiment where the electric heater power supplies 204 are themselves identical.

It is noted that the differences in the magnitudes of the voltages of the electric heater power supplies 204, and the differences in the resistances of the heating elements, can result in the heater power supplies 204 affecting the electric field holding down the media. There is substantially no interference between the heater power supplies 204 and the high-voltage source 202 on the electric field holding down the media where the resistances of the power supplies 204 are substantially equal.

Fluid-Ejection Device and Methods

Figure 5:
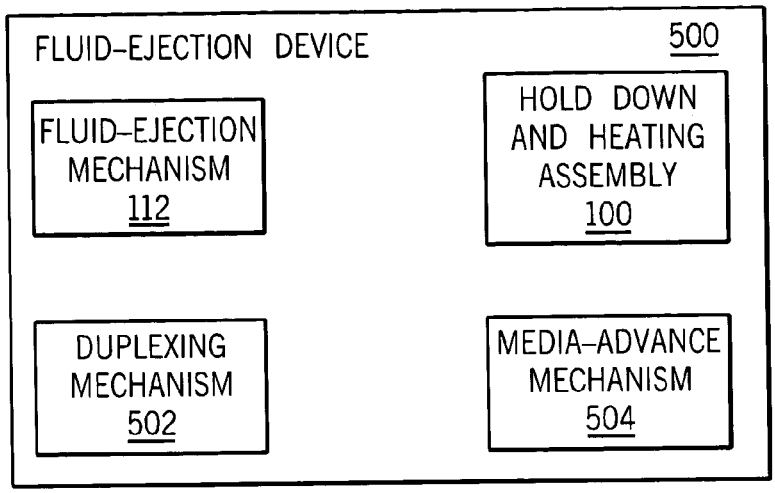
FIG. 5 is a block diagram of a fluid-ejection device, according to an example embodiment.

FIG. 5 shows a block diagram of a fluid-ejection device 500, according to an embodiment of the invention. The fluid-ejection device 500 includes the fluid-ejection mechanism 112 and the hold down and heating assembly 100 that have been described. The fluid-ejection device 500 also optionally includes a duplexing mechanism 502 and/or a media-advance mechanism 504. The fluid-ejection device 500 may include other components in addition to or in lieu of those depicted in FIG. 5.

The fluid-ejection mechanism 112 ejects fluid onto the media 108 of FIG. 1. Where the fluid is ink, the fluid-ejection mechanism 112 is an inkjet-printing mechanism, such as an inkjet printhead, and the fluid-ejection device 500 is an inkjet-printing device, such as an inkjet printer or another device that includes inkjet-printing functionality. The hold down and heating assembly 100 is an electrostatic hold down and conductive heating assembly, and may be implemented in one embodiment as has been described in the preceding sections of the detailed description. Thus, the assembly 100 electrostatically holds down the media 108 for the fluid-ejection mechanism 112 to eject fluid onto the media 108, and conductively heats the media 108 to substantially dry the fluid ejected onto the media 108.

The duplexing mechanism 502 is an optional mechanism that allows the fluid-ejection mechanism 112 to eject fluid onto both sides of the media 108 of FIG. 1 without manual reinsertion of the media 108 into the fluid-ejection device 500 by a user, after one side of the media 108 has had fluid ejected onto it. For instance, the fluid-ejection mechanism 112 may eject fluid over the media swaths of one side of the media 108. The duplexing mechanism 502 then effectively flips over the media 108, so that the fluid-ejection mechanism 112 may eject fluid over the media swaths of the other side of the media 108.

The media-advance mechanism 504 is a mechanism that advances the 20 media 108 of FIG. 1 past and between the fluid-ejection mechanism 112 and the media hold down and heating assembly 100 in one embodiment of the invention. For instance, the media-advance mechanism 504 may advance the media so that a current swath of the media 108 lies between the mechanism 112 and 100. The fluid-ejection mechanism 112 ejects fluid onto this media swath while the media hold down and heating assembly 100 electrostatically holds down the media 108. The media hold down and heating assembly 100 then conductively heats the media 108 to substantially dry the fluid ejected onto the media swath. The media-advance mechanism 504 advances the media 108 to a next media swath on which fluid is to be ejected, and this process continues until the media 108 has had fluid ejected thereon as intended.

Figure 6:
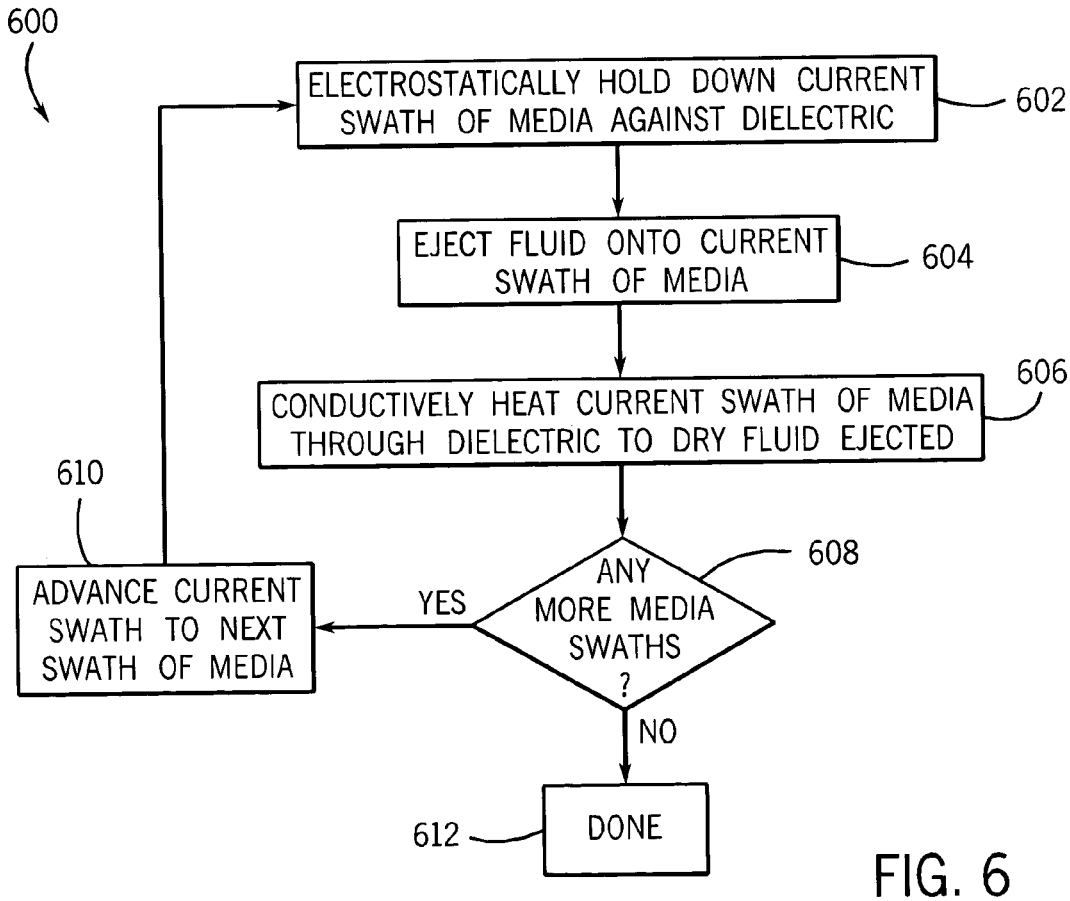
FIG. 6 is a flowchart of a method of use, according to an example embodiment.

FIG. 6 shows a method of use 600, according to an embodiment of the invention. The method 600 may be performed by the fluid-ejection device 500 of FIG. 5, and/or the media hold down and heating assembly 100 of FIG. 1. A current swath of the media 108 is electrostatically held down against the dielectric 102 of FIG. 1 (602). While the current swath of the media 108 of FIG. 1 is held down, the fluid 114 of FIG. 1 is ejected onto the current swath (604), and the current swath of the media 108 is conductively heated through the dielectric 102 to at least substantially dry the fluid 114 ejected (606). If there are any more swaths on the media 108 (608), then the current swath is advanced to the next swath of the media 108 (610), and the method 600 repeats at 602. Otherwise, the method 600 is finished (612). In one embodiment, media 108 is concurrently heated (606) and electrostatically held down (602) as fluid is ejected onto the media (604). In another embodiment, media 108 is heated (606) after concurrent holding down (602) of media 108 and ejection of fluid (604) onto the media 108.

Figure 7:
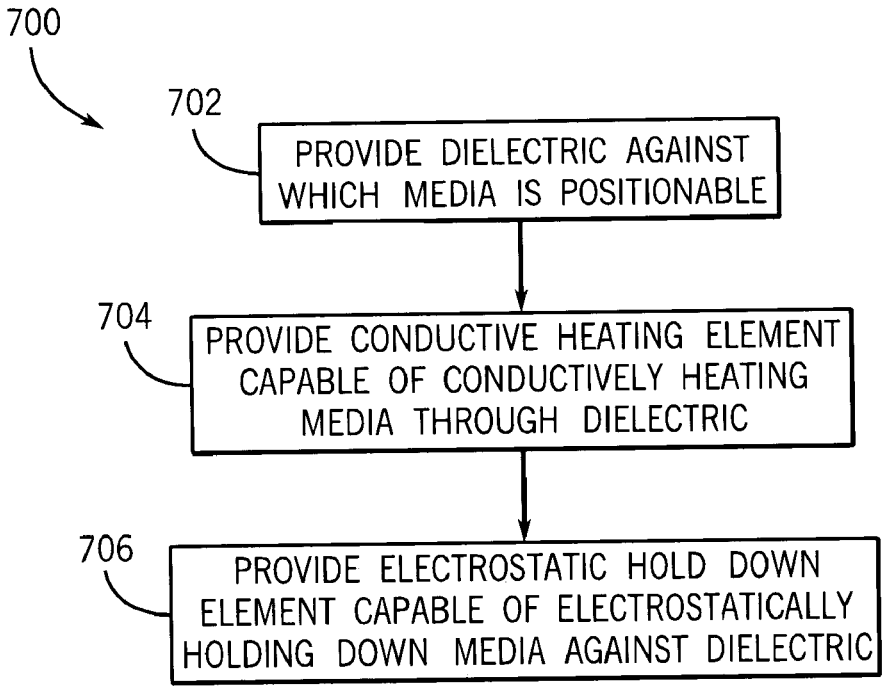
FIG. 7 is a flowchart of a method of manufacture, according to an example embodiment of the invention.

FIG. 7 shows a method of manufacture 700, according to an embodiment of the invention. The method 700 may be performed to at least partially manufacture the media hold down and heating assembly 100 of FIG. 1, and/or the fluid-ejection device of FIG. 5. The dielectric 102 of FIG. 1 is provided, against which the media 108 of FIG. 1 is positionable (702). The conductive heating element 106 of FIG. 1 is also provided, which is capable of conductively heating the media 108 through the dielectric 102 (704). Finally, the electrostatic hold down element 104 of FIG. 1 is provided, which is capable of electrostatically holding down the media 108 against the dielectric 102.

Media Hold Down System 800

Figure 8:
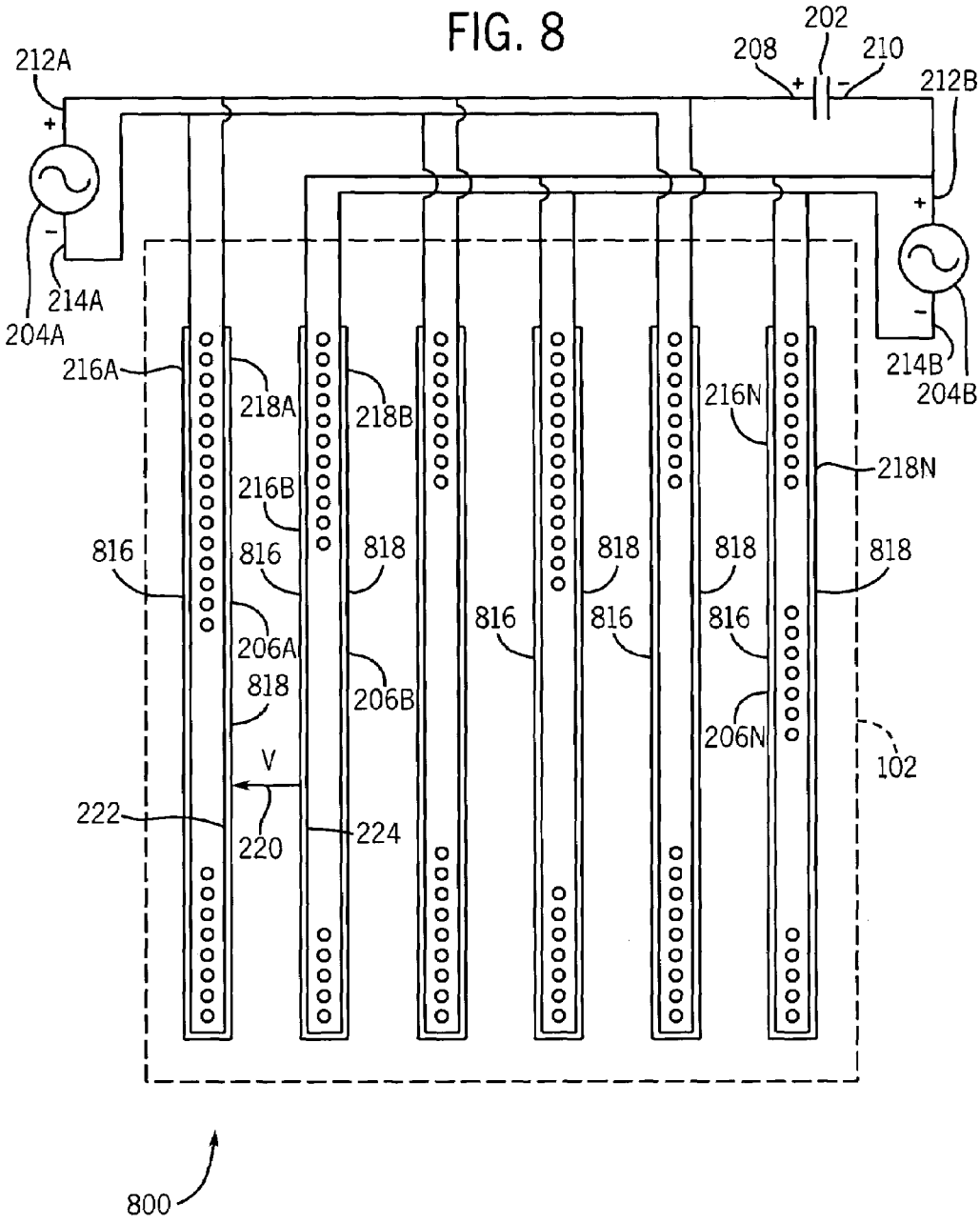
FIG. 8 is a diagram of a cross-sectional top view of another example embodiment of the media hold down system of FIG. 2.
Figure 9:
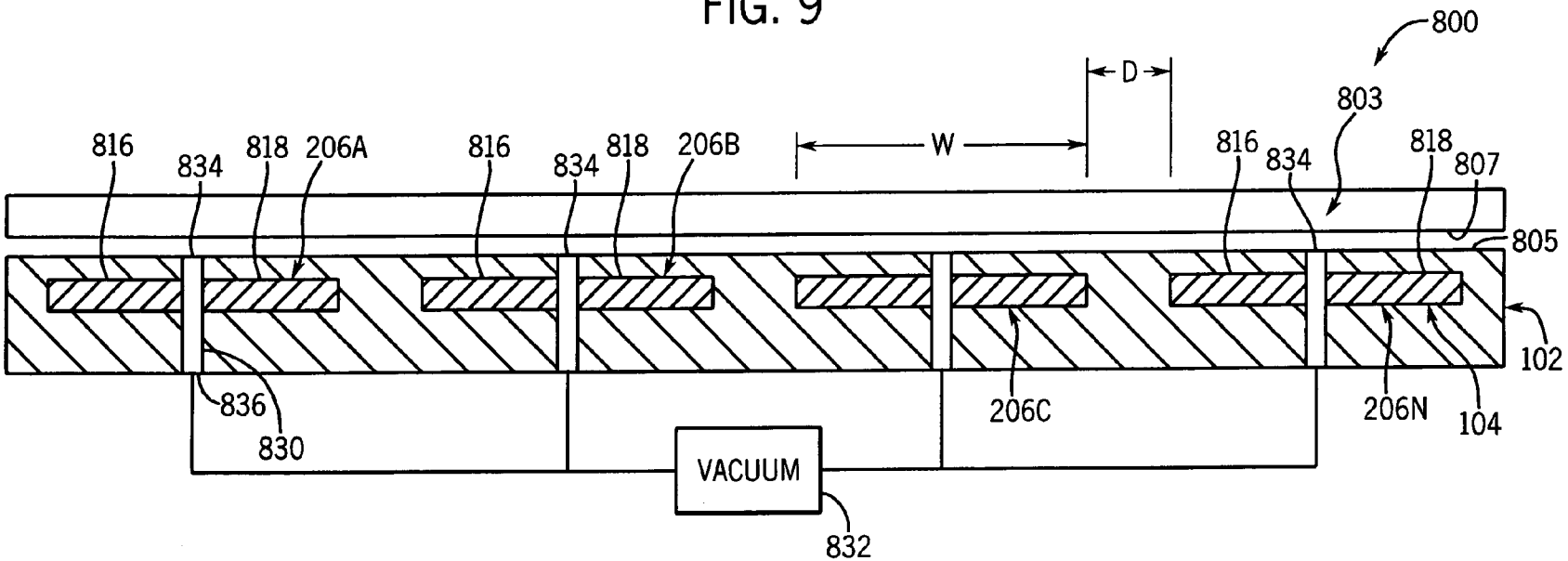
FIG. 9 is a sectional view of the media hold down system of FIG. 8 taken along line 9—9, according to an example embodiment.

FIG. 8 schematically illustrates media hold down system 800, another embodiment of the media hold down and heating assembly 100, shown and described with respect to FIG. 2. Media hold down system 800 is substantially identical. to media hold down and heating assembly 100 except that media hold down system 800 additionally includes passages 830 and vacuum source 832 (shown in FIG. 9). For ease of illustration, those remaining elements of media hold down system 800 which correspond to elements of media hold down and heating assembly 100 are numbered similarly. As shown by FIG. 9, passages 830 extend within dielectric 102. Each passage 830 includes openings 834 and 836. Openings 834 are generally located along surface 805 of dielectric 102 and are generally aimed at medium 803. Openings 836 are in pneumatic communication with openings 834 and are further in pneumatic communication with vacuum source 832. For purposes of this disclosure, the term "pneumatic communication" means that two air or gas containing volumes are connected to one another in such a way that air or gas may flow in one or both directions between such volumes. As best shown by FIG. 8, passages 830 and openings 834 are generally situated along dielectric 102 between portions 816 and 818 of each of electrodes 206A–206N. Because openings 834 are located between portions 816 and 818 of each electrode 206 which have the same polarity, openings 834 minimally impact upon the electrostatic hold down force created by system 800.

Vacuum source 832 generally comprises a mechanism configured to create a vacuum across openings 834 and 836 to remove air from between surface 805 and medium 803. Vacuum source 832 removes air from between surface 805 and medium 803. In those applications in which medium 803 carries fluid, such as ink that is being dried, vacuum source 832 removes moisture or vapor laden air between surface 805 and medium 803 to facilitate faster drying of the fluid on medium 803. In addition, vacuum source 832 draws medium 803 into closer proximity with surface 805 of dielectric 102. By drawing medium 803 into closer proximity with surface 805, vacuum source 832 enables system 800 to apply a greater electrostatic hold down force to medium 803. This synergistic result improves the ability of system 800 to maintain medium 803 in place and to prevent cockle of the medium without requiring additional proportional amounts of energy.

In the particular embodiment illustrated, electrostatic hold down element 104, vacuum source 832 and openings 834 are configured such that the electrostatic hold down force applied by element 104 to medium 803 is greater than the vacuum hold down force provided by vacuum source 832 and openings 834. In one embodiment, over 90% of the total hold down force. applied to medium 803 is provided by electrostatic hold down element 104. As a result, media hold down system 800 has a much lower power consumption and is more efficient as compared to systems which rely upon vacuum source 832 for supplying a majority if not all of the hold down force that is applied to medium 803.

Figure 10:
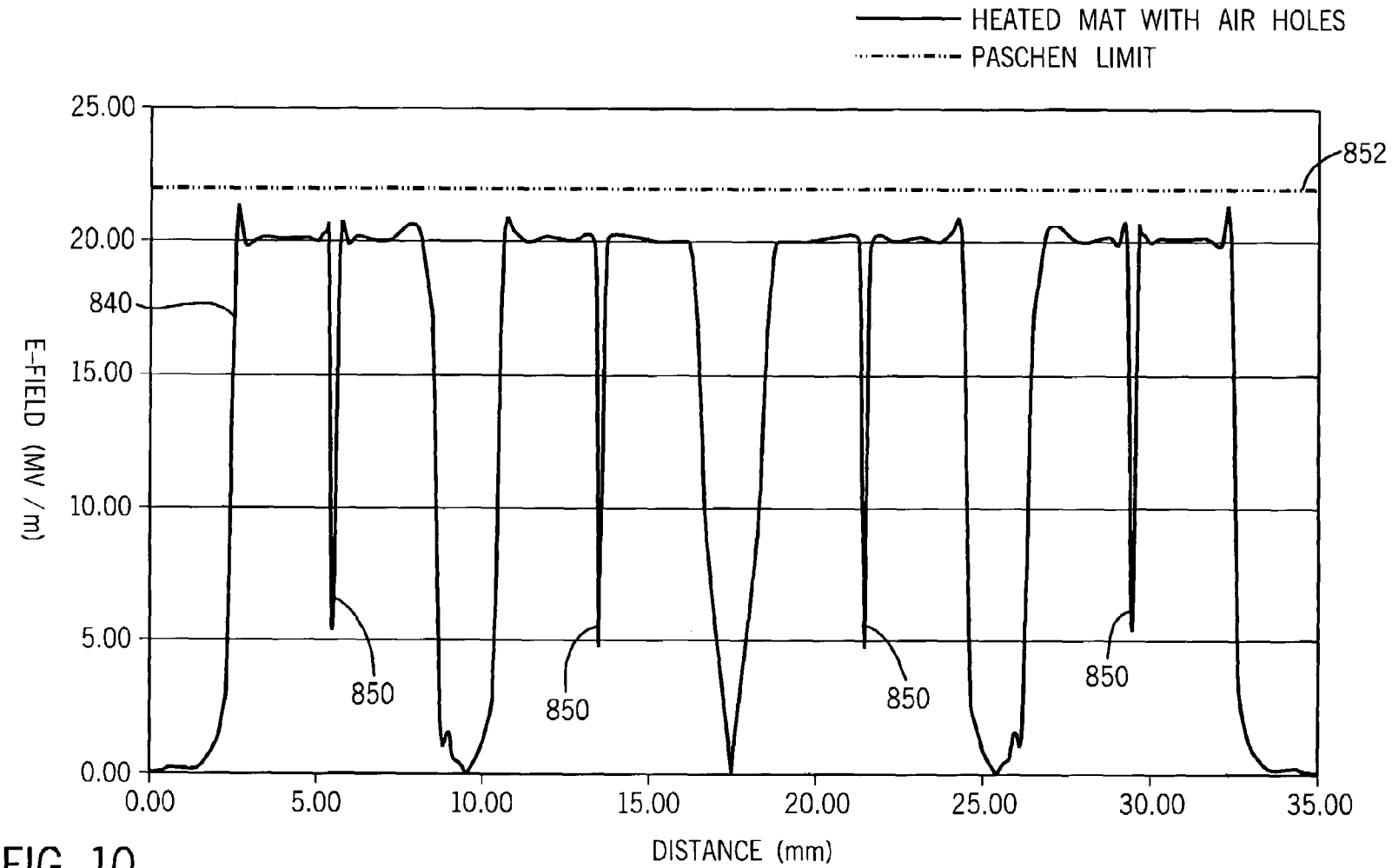
FIG. 10 is a graph illustrating electric field strength along a surface of one example embodiment of the media hold down system of FIGS. 8 and 9.

FIG. 10 graphically illustrates example electric field strength (which corresponds to electrostatic hold down force) across dielectric 102 and by media hold down system 800 shown in FIG. 9 prior to the application of a vacuum by source 832, wherein medium 803 comprises paper having a relative permittivity of 2.0 and a conductivity of 3e−8 Mho/m, wherein openings 834 have a diameter of 8 mils, wherein medium 803 is configured such that a 20 micron air gap exists between lower surface 807 of medium 803 and surface 805 of dielectric 102, wherein electrodes 206 are 1 mil below surface 805, wherein each electrodes 206A–206N is formed from copper and has a total width W of approximately 6 millimeters and wherein consecutive electrodes 206A–206N are spaced along surface 805 by a distance D of one-third W, 2 millimeters, wherein dielectric 102 comprises a silicon rubber mat having a relative permittivity of 2.0 and a conductivity of 1e−17 Mho/M and wherein electrodes 206A–206N are alternately charged at +550 volts and −550 volts. Line 840 represents a magnitude of the electrostatic field at a point exactly 10 microns above surface 805 starting from the left end of surface 850 as shown in FIG. 9. The magnitude of the electrostatic field is directly proportional to the electrostatic hold down force exerted upon medium 803. As shown by FIG. 10, the electrostatic hold down force is greatest directly between electrodes 206 and medium 803. As shown by FIG. 10, the amount of electrostatic hold down force drops along openings 834 as indicated by portions 850. However, this drop off in electrostatic hold down force is negligible in many implementations due to the dimensioning of openings 834. In one embodiment, openings 834 may have a diameter no greater than 10 mils. In one other embodiment, openings 834 have a diameter of approximately 4 mils. In alternative embodiments, the diameter of openings 834 may vary.

Line 852 indicates the Paschen limit. The Paschen limit is a physical limit at which point the electric field will break down and conduct. The particular embodiment of the media hold down system described maximizes the electric field strength without exceeding the Paschen limit. The Paschen limit is not only a function of the electrical field magnitude, but it is also a function of a gap between two potentials (i.e., electrodes 206 and medium 803). The closer media 803 is to electrodes 206, the higher the Paschen limit. Because vacuum source 832 and openings 834 cooperate to draw medium 803 closer to surface 805 and to further reduce the gap between surface 807 of medium 803 and surface 805 of dielectric 102, the Paschen limit line 852 shown in FIG. 10 will rise upon the application of a vacuum by source 832. Increasing the Paschen limit enables a larger voltage to be provided by voltage source 102 (shown in FIG. 8) to increase the magnitude of the electric field and the resulting electrostatic hold down force without broaching the Paschen limit. As a result, vacuum source 832 and openings 834 cooperate with electrostatic hold down element 104 to enable electrostatic hold down element 104 to create an even larger electrostatic hold down force for holding medium 803 against surface 805.

Fluid Ejection Device 900

Figure 11:
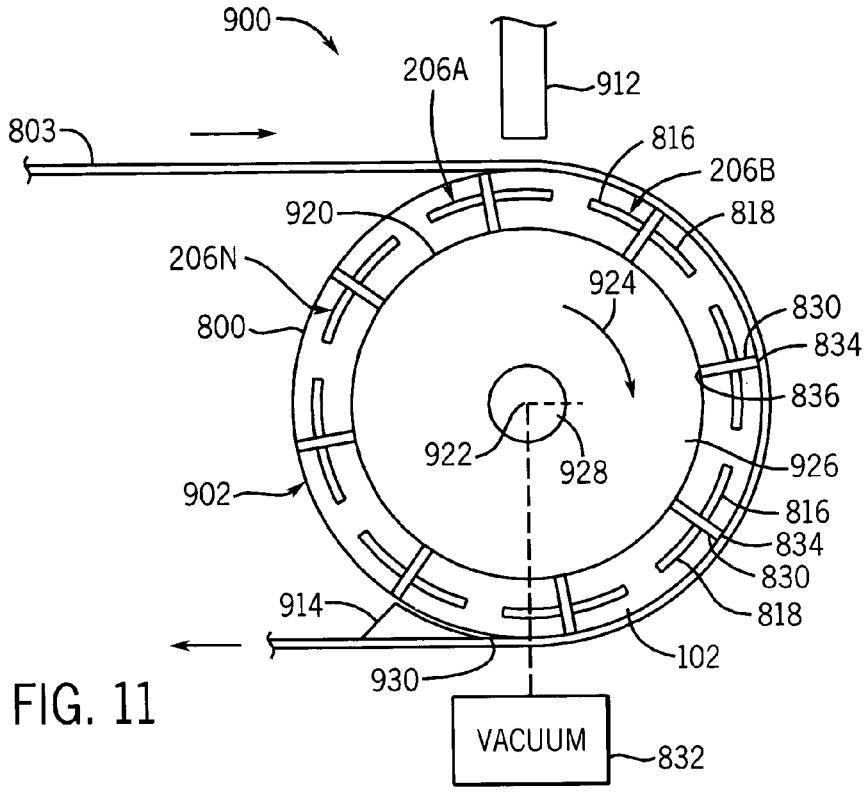
FIG. 11 schematically illustrates a fluid ejection device incorporating the media hold down system of FIGS. 8 and 9, according to an example embodiment.

FIG. 11 schematically illustrates fluid ejection device 900 which includes roller or drum 902, fluid ejection mechanism 912 and medium release 914. FIG. 11 further illustrates medium 803 being transported by drum 902. Drum 902 includes cylindrical support 920 and media hold down system 800. Cylindrical support 920 comprises a structure configured to be rotated about axis 922 in the direction indicated by arrow 924 while supporting media hold down system 800. In one embodiment, support 920 comprises a cylindrical member to which media hold down system 800 is affixed. In another embodiment, support 920 comprises a general frame work extending about axis 922 and coupled to media hold down system 800.

Media hold down system 800 at least partially encircles axis 922 and is rotatably driven by a motor (not shown) about axis 922 in the direction indicated by arrow 924. As shown by FIG. 11, only a portion of drum 902 contacts media 803 at any moment. The diameter of drum 902 is selected such that medium 803 is held in tight contact with the exterior circumferential surface of drum 902 for a sufficient period of time for the moisture absorbed by medium 803 to evaporate and for the cockle to be controlled.

As shown by FIG. 11, vacuum source 832 is generally located external to support 920 and is in pneumatic communication with interior 926 of drum 902 which pneumatically communicates with each of passages 830. In one embodiment, vacuum source 832 is pneumatically coupled to interior 926 through axle 928 which rotatably supports drum 902. In alternative embodiments, vacuum source 832 may be pneumatically coupled to interior 926 by various other structures and coupling arrangements. Although not illustrated, voltage source 202 and current sources 204A and 204B (shown in FIG. 8) are electrically coupled to electrodes 206A–206N by couplers which enable drum 202 to rotate about axis 922.

Fluid ejection mechanism 912 comprises a device configured to eject fluid onto medium 803. In one embodiment, mechanism 912 comprises an inkjet printhead configured to eject ink onto surface 809. In other embodiments, ejection mechanism 912 may be configured to eject other fluids onto medium 803. Once a fluid is ejected onto medium 803, medium 803 is transported about axis 922 while being held against drum 902 by media hold down system 800. As a result, cockle (i.e., expansion of medium 803 as medium 803 absorbs moisture) is controlled. In the particular embodiment illustrated in which hold down system 800 additionally heats medium 803, cockle of medium 803 is even further reduced.

Once the medium 803 has been transported to point 930 on drum 902, medium release 914 separates medium 803 from drum 902 for further operations upon medium 803 or for discharge of medium 803 from fluid ejection device 900. In the embodiment illustrated, medium release 914 comprises a wedge extending into contact with drum 902 at point 930. Release 914 pries medium 803 away from the surface of drum 902. In lieu of or in addition to the use of medium release 914 to remove medium 803 from drum 902, various other mechanisms may be employed to separate medium 803 from drum 802.

Fluid Ejection Device 1000

Figure 12:
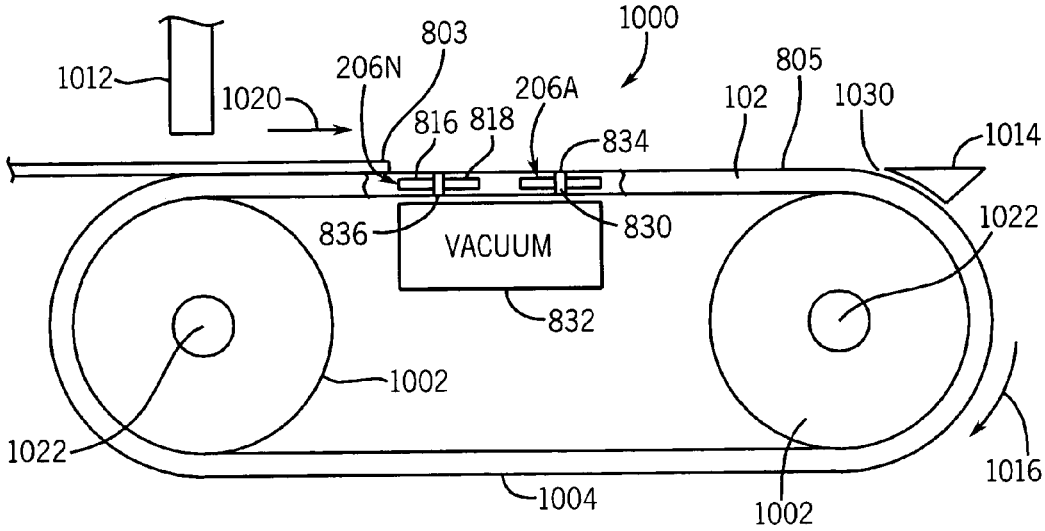
FIG. 12 schematically illustrates another example embodiment of a fluid ejection device incorporating the media hold down system of FIGS. 8 and 9.

FIG. 12 schematically illustrates fluid ejection device 1000 which generally includes rollers 1002, belt 1004, fluid ejection mechanism 1012 and medium release 1014. Rollers 1002 are configured to rotatably drive belt 1004 in the direction indicated by arrow 1016. Although device 1000 is illustrated as including two rollers, device 1000 may alternatively include a greater number of rollers.

Belt 1004 extends about rollers 1002 and is configured to transport medium 803 relative to fluid-ejection mechanism 1012 in the direction indicated by 1020. Belt 1004 incorporates electrodes 206A–206N and passage 834 of media hold down system 800. In one embodiment, a substantial portion of belt 1004 is formed from a dielectric material. In another embodiment, a surface portion of belt 1004 includes dielectric 102. Electrodes 206 are electrically coupled to voltage source 202 and current sources 204A, 204B (shown in FIG. 8) while still permitting belt 1004 to be driven about axes 1022 of rollers 1002.

As further shown by FIG. 12, only a portion of belt 1004 contacts medium 803 at any point in time. Vacuum source 832 is located between axes 1022 and is configured to remove air from between medium 803 and surface 805 of belt 1004 as belt 1004 is moved relative to vacuum source 832. In another embodiment, vacuum source 832 may be located outside of axes 1022 and belt 1004, wherein vacuum source 832 is in pneumatic communication with a plenum or chamber between axes 1022 along a lower surface of belt 1004 so as to be in pneumatic communication with passages 834.

Fluid ejection mechanism 1012 generally comprises a mechanism configured to eject fluid onto medium 803. In one embodiment, mechanism 1012 comprises an inkjet printhead configured to deposit ink upon medium 803. Once the fluid is deposited upon medium 803, the belt transfers medium 803 across vacuum source 832 while media hold down system 800 hold medium 803 against the surface of belt 1004 and while vacuum source 832 removes moisture laden air from between belt 1004 and media 103. In the particular embodiment illustrated, media hold down system 800 additionally heats media 803 to further control cockle of media 803 caused by the absorption of moisture. Medium 803 is held against belt 1004 by media hold down system 800 for a sufficient period of time such that the cockle of media 803 is reduced or eliminated.

Release 1014 generally comprises a wedge configured to contact medium 803 at location 1030 so as to separate and remove medium 803 from belt 1004 for additional handling or processing or for discharge of medium 803 from device 1000. In alternative embodiments, other mechanisms may be employed for separating medium 803 from belt 1004.

Overall, media hold down system 800 effectively reduces medium cockle caused by the absorption of moisture by the medium. Media hold down system 800 simultaneously holds the medium against the surface of the dielectric using electrostatic hold down forces to reduce cockle, heats the medium to evaporate absorbed moisture and withdraws moisture laden air from between the medium and the surface of the dielectric. Because the vacuum source 832 draws the medium into closer proximity with the dielectric surface to raise the Paschen limit, a greater electric field and electrostatic hold down force may be created to hold the medium against the dielectric surface. At the same time, because media hold down system 800 relies largely upon the electrostatic hold down force to hold the medium, system 800 consumes less energy and is more efficient.

Although media hold down system 800 is illustrated as being configured to additionally heat the medium 803 as the medium is being held down, in other embodiments, media hold down system 800 may omit a heating element. For example, in one embodiment, media hold down system 800 may omit current sources 204A and 204B, wherein consecutive electrodes 206 are alternately electrically coupled to the positive and negative terminals of voltage source 202. Although media hold down system 800 is illustrated as creating vacuum between the surface against which the medium is held and the medium itself by drawing air in a direction generally nonparallel to the dielectric surface and the medium, media hold down system 800 may alternatively include a vacuum source configured to create a vacuum between the dielectric surface and the medium by drawing air out from between the dielectric surface and the medium in directions parallel to the medium and the dielectric surface. For example, medium hold down system 800 may alternatively include vacuum ports situated along edges of the dielectric surface.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media hold down system comprising:

electrodes configured to create an electric field at a surface, the electrodes including a first electrode, a second electrode and a third electrode between the first electrode and the second electrode, wherein the third electrode is configured to be at a charge distinct from that of the first electrode and the second electrode and wherein the third electrode has a first side facing the first electrode and a second opposite side facing the second electrode;

a first opening between the first side and the second side of the third electrode; and a vacuum source configured to create a vacuum through the first opening at the surface.

2. The system of claim 1 including a first current source electrically coupled to spaced portions of one of the electrodes.

3. The system of claim 2 including a second current source electrically coupled to spaced portions of the other of the electrodes.

4. The system of claim 1 wherein the first opening is between a first portion and a second portion of one of the electrodes.

5. The system of claim 4 including a second opening along the surface, wherein the vacuum source is configured to create a vacuum through the second opening.

6. The system of claim 5, wherein the second opening is between a third portion and a fourth portion of the other of the electrodes.

7. The system of claim 5, wherein the second opening is between the first side and the second side of the third electrode.

8. The system of claim 1, wherein the third electrode has a transverse width W and wherein the first and second electrodes are transversely spaced from the third electrode by a distance of about one-third W.

9. The system of claim 1, wherein the surface is configured to be moved while the media is positioned against the surface.

10. The system of claim 1, wherein the electrodes are configured to create an electrostatic hold down force between the surface and the medium, wherein the vacuum source creates a vacuum hold down force and wherein the electrostatic hold down force is greater than the vacuum hold down force.

11. The system of claim 1, wherein one of the electrodes has a first portion opposite a second portion, wherein the first portion is transversely spaced from the second portion by a distance D, wherein the first opening is between the first portion and the second portion and has a transverse dimension substantially equal to the distance D.

12. The system of claim 11, wherein the transverse dimension D is less than about 10 mils.

13. The system of claim 1 including a heating element at least partially disposed within the surface.

14. The system of claim 1 further comprising a current source electrically coupled to at least one of the first electrodes such that electrical current flows through the at least one of the first electrodes.

15. A media hold down system comprising:

a surface configured to be positioned against a medium;

a capacitive electrostatic hold down element including a first electrode and a second electrode;

a vacuum source configured to create a vacuum through an opening within one of the first electrode and the second electrode at the surface.

16. The system of claim 15 including a heating element proximate to surface.

17. The system of claim 16, wherein the heating element and the electrostatic hold down element include a common electrode along the surface.

18. The system of claim 16, wherein the electrostatic hold down element includes:

a voltage source;

a first electrode proximate the surface, electrically coupled to the voltage source and configured to have a positive charge; and a second electrode proximate the surface, electrically coupled to the voltage source and configured to have a negative charge.

19. The system of claim 18, wherein the heating element includes a first current source electrically coupled to spaced portions of one of the first electrode and the second electrode such that current flows through said one of the first electrode and the second electrode.

20. The system of claim 19 including a second current source electrically coupled to spaced portions of the other of the first electrode and the second electrode.

21. The system of claim 19, wherein the current source comprises a source of alternating current.

22. The system of claim 18, including a first opening between a first portion and a second portion of one of the first electrode and the second electrode, wherein the vacuum source is configured to create a vacuum through the first opening.

23. The system of claim 18 including a second opening along the surface.

24. The system of claim 23, wherein the second opening is between a third portion and a fourth portion of the other of the first electrode and the second electrode.

25. The system of claim 23, wherein the second opening is between the first portion and the second portion of said one of the first electrode and the second electrode.

26. The system of claim 18, wherein one of the first electrode and the second electrode has a transverse width W and wherein the first electrode and the second electrode are transversely spaced from each other by a distance about one-third W.

27. The system of claim 18, wherein the first electrode has a first portion opposite a second portion, wherein the first portion is transversely spaced from the second portion by a distance D and wherein the second opening is between the first portion and the second portion and has a transverse dimension substantially equal to the distance D.

28. The system of claim 27, wherein the transverse dimension is less than about 10 mils.

29. The system of claim 16, wherein the heating element includes:

an electrode proximate the surface; and a current source electrically coupled to spaced portions of the electrode.

30. The system of claim 15, wherein the surface is configured to be moved while the medium is held against the surface by the electrostatic hold down element.

31. The system of claim 15, wherein the electrostatic hold down element is configured to create an electrostatic hold down force between the surface and the medium, wherein the vacuum source is configured to create a vacuum hold down force and wherein the electrostatic hold down force is greater than the vacuum hold down force.

32. The system of claim 15, wherein the first current source supplies alternating current.

33. A fluid ejection system comprising:

a fluid ejection mechanism configured to eject fluid onto a medium;

a surface configured to be positioned against the medium;

a capacitive electrostatic hold down element including an electrode;

a vacuum source configured to create a vacuum between the surface and the medium, wherein the vacuum source creates the vacuum through an opening within the electrode.

34. The system of claim 33 including a heating element proximate the surface.

35. The system of claim 34, wherein the heating element and the electrostatic hold down element include a common electrode along the surface.

36. The system of claim 33, wherein the fluid ejection mechanism is configured to eject ink onto the medium.

37. The system of claim 33, wherein the surface is configured to be moved while the medium is held against the surface.

38. The system of claim 37, wherein the surface is provided by a belt.

39. The system of claim 37, wherein the surface substantially encircles a drum.

40. A media hold down system comprising:

means for electrostatically holding a medium along a surface including an electrode;

means for removing air between the medium and the surface as the medium is held down through an opening within the electrode.

41. The system of claim 40 including means for heating the medium as the medium is held down.

42. The system of claim 41, wherein the means for heating is at least partially received within the surface.

43. A method for handling media, the method comprising:

electrostatically holding a medium along a surface with differently charged electrodes; and removing air between the medium and the surface as the medium is held down through openings within at least one of the electrodes.

44. The method of claim 43 including the heating the medium as the medium is held down.

45. The method of claim 43 including moving the surface as the medium is held along the surface.

46. The method of claim 43 further comprising transmitting electrical current through the electrodes to heat the medium.

* * * * *

UNITED STATES PATENT AND TRADEMARK OFFICE

CERTIFICATE OF CORRECTION

PATENT NO. : 6,997,549 B2
APPLICATION NO. : 10/788186
DATED : February 14, 2006
INVENTOR(S) : Steven J. Howarth et al.

It is certified that error appears in the above-identified patent and that said Letters Patent is hereby corrected as shown below:

In column 12, lines 12–13, in Claim 14, delete “electrodes” and insert -- electrode --, therefor.

In column 12, line 14, in Claim 14, delete “electrodes” and insert -- electrode --, therefor.

Signed and Sealed this

Fourteenth Day of July, 2009

John Doll

JOHN DOLL
*Acting Director of the United States Patent and Trademark Office*